United States Patent [19]

Gagné

[11] Patent Number: 4,457,483

[45] Date of Patent: Jul. 3, 1984

[54] COLLAPSIBLE SUPPORT FOR GARBAGE BAGS

[76] Inventor: Lauréat Gagné, 3 Morley St., Greenfield Park, Quebec, Canada, J4V 2Y8

[21] Appl. No.: 309,584

[22] Filed: Oct. 8, 1981

[51] Int. Cl.[3] ..... B65B 67/12

[52] U.S. Cl. ..... 248/97; 248/99

[58] Field of Search ..... 248/95, 97, 99, 101, 248/542, 100; 24/30.5 S; 211/89

[56] References Cited

U.S. PATENT DOCUMENTS

| | | | |
|---|---|---|---|
| 1,953,042 | 3/1934 | Cody | 248/101 X |
| 2,030,996 | 2/1936 | Lustig | 24/30.5 S |
| 2,775,812 | 1/1957 | Mohr | 248/542 X |
| 3,019,152 | 1/1962 | Jones | 24/217 X |
| 3,779,419 | 12/1973 | Heitz | 248/99 X |
| 4,037,778 | 7/1977 | Boyle | 248/99 X |
| 4,280,676 | 7/1981 | Betts | 248/99 X |

FOREIGN PATENT DOCUMENTS

| | | |
|---|---|---|
| D38322 | 4/1970 | Canada . |
| 986896 | 4/1976 | Canada . |
| 1022522 | 12/1977 | Canada . |

*Primary Examiner*—J. Franklin Foss
*Assistant Examiner*—David L. Talbott
*Attorney, Agent, or Firm*—Swabey, Mitchell, Houle, Marcoux & Sher

[57] ABSTRACT

The invention is concerned with a collapsible support for bags which is formed from a one-piece blank made of flexible sheet material and has fastening means holding the sheet material to define an open-ended form-retaining structure for receiving a bag and supporting same in an upright open-mouthed position. The form-retaining structure has a solid circumferential sidewall extending substantially the full height of the bag in its upright position, whereby to permit a peripheral end portion of the bag to be retained folded over an upper edge of the sidewall. The bag support of the invention permits the bag to be easily withdrawn therefrom, prevents sharp objects from piercing the bag when it is inserted into the bag to form a protective liner for the bag, and can be collapsed for convenient storage and/or handling.

12 Claims, 14 Drawing Figures

42
28
30
22

34
36
32

20
42

40

COLLAPSIBLE SUPPORT FOR GARBAGE BAGS

FIELD OF THE INVENTION

The present invention relates to a bag support and, more particularly, to a collapsible support for bags which is formed from a single blank made of flexible sheet material and which can be dissassembled into a collapsed structure for convenient storage and/or handling.

By the expression "collapsed structure" is meant a structure having a substantial reduction of dimensions at least in one direction, such as a flat or coiled structure.

When utilizing a garbage can to support a plastic garbage bag having a peripheral end portion folded over the top edge of the can, the bag generally adheres to the sidewall of the can even when it is only partially loaded. It is thus often difficult to withdraw the bag due to the adherence thereof to the can sidewall as well as to the vacuum which is created between the bottom of the bag and that of the can when the bag is pulled out of the can. On the other hand, one can hardly do without a garbage can or the like to support a garbage bag since the bag itself has no body as such and is therefore not self-supporting, and without external support the bag can be loaded only with great difficulty.

Moreover, when using the bags outdoors for the disposal of scrap pieces of wood, small rocks and the like, particular care must be taken during loading in order to prevent such sharp objects from piercing the bags. In addition, the presence of sharp objects does not permit the garbage to be compressed inside the bag since otherwise the latter would pierce, thus resulting in one not being able to load the bag to its full capacity. The same also applies to indoor use as household rubbish generally includes sharp items such as pizza boxes, broken glass, open cans and the like.

Finally, conventional bag supports such as garbage cans are generally bulky items which require considerable space for storage as well as for display in retail stores, and are awkward to handle due to their bulkiness. It would thus be desirable if such items could be collapsed so as to require less space and be more convenient to handle.

SUMMARY OF THE INVENTION

It is therefore an object of the present invention to eliminate the above problems and to provide a bag support which permits the bag to be easily withdrawn, prevents sharp objects from piercing the bag and yet can be collapsed for convenient storage and/or handling.

According to one aspect of the invention, there is provided a collapsible support for bags which is formed from a one-piece blank made of flexible sheet material and has fastening means holding the sheet material to define an open-ended form-retaining structure for receiving a bag and supporting same in an upright open-mouthed position. The form-retaining structure has a solid circumferential sidewall extending substantially the full height of the bag in its upright position, whereby to permit a peripheral end portion of the bag to be retained folded over an upper edge of the sidewall.

By the expression "form-retaining structure" is meant a structure which maintains under load its shape once formed. Thus, the sheet material must be sufficiently rigid to support a bag during loading without being deformed by the load, and yet be flexible enough to enable one to easily manipulate the sheet material by bending or folding so as to obtain the desired bag-supporting structure or, conversely, to collapse such structure into one of reduced dimensions. Such bag-supporting structure may be, for instance, cylindrical in shape and open at both ends thereof.

A preferred bag support according to the invention further includes bag attachment means integrally formed in the sheet material for releasably securing the bag in the open-mouthed position. Such bag attachment means preferably comprise a plurality of partially cut-out tabs and respective cut-out openings formed in the sheet material and spacedly arranged adjacent at least one of opposite end edges thereof, each tab extending in a direction toward the at least one end edge and being resiliently urged to normally close its respective opening. By folding a peripheral end portion of the bag over the one end edge which constitutes the upper edge of the support sidewall and inserting same through a cut-out opening against the closing force exerted by its respective tab, the bag peripheral end portion is thus entrapped by the tab and opening arrangement. Repeating this procedure for each tab and opening arrangement provided adjacent the edge enables the bag to be positively held in position for loading. Each tab is formed with a smooth curved edge for engaging the folded peripheral end portion of the bag without damaging same.

The fastening means which hold the sheet material to define an open-ended form-retaining structure are advantageously releasable. Such releasable fastening means preferably comprise at least one knob integrally formed in the sheet material adjacent one of opposite side edges thereof, the at least one knob being received in snap-fit engagement through a corresponding opening provided in the sheet material adjacent the other side edge thereof. Such type of fastening means has the advantage of being able to withstand shear as well as tensile forces exerted through the sheet material during use of the bag support.

According to a further aspect of the invention, there is provided a one-piece blank for forming a collapsible support for bags, which blank comprises an elongated sheet of flexible material having a pair of parallel longitudinal edges and a pair of transverse side edges, and fastening means adjacent the side edges for holding the sheet to define an open-ended form-retaining structure for receiving a bag and supporting same in an upright open-mouthed position, when the blank is formed into the support. The sheet has a width dimensioned such that the form-retaining structure has a solid circumferential sidewall extending substantially the full height of the bag in its upright position, whereby to permit a peripheral end portion of the bag to be retained folded over an upper edge of the sidewall.

Such blank can be manufactured at a high rate of production from a roll of the sheet material using a suitable die.

The provision of an open-ended structure for receiving the bag and supporting same eliminates the vacuum normally encountered during the withdrawal of the bag since the structure has an open bottom. In the case where a loaded bag adheres to the sidewall of the bag support and where releasable fastening means are employed, the bag can be liberated from its support by simply releasing the fastening means to enable the bag support to be dissassembled and to thereby expose the bag.

The bag support of the invention may receive a bag not only therein as in the conventional manner, but also thereover. In other words, it may be inserted into the bag to form a protective liner for the bag and to thereby prevent sharp objects from piercing the bag.

Finally, by releasing the fastening means the bag support may be collapsed into a flat structure allowing piling of same for convenient storage. Alternatively, the sheet material may be rolled upon itself to form a coiled structure; several sheets may of course be rolled together into a bundle for convenient display in retail stores.

BRIEF DESCRIPTION OF THE DRAWINGS

A preferred embodiment of the invention will now be described with reference to an example thereof as illustrated in the accompanying drawings, wherein.

DESCRIPTION OF PREFERRED EMBODIMENTS

Figure 1:
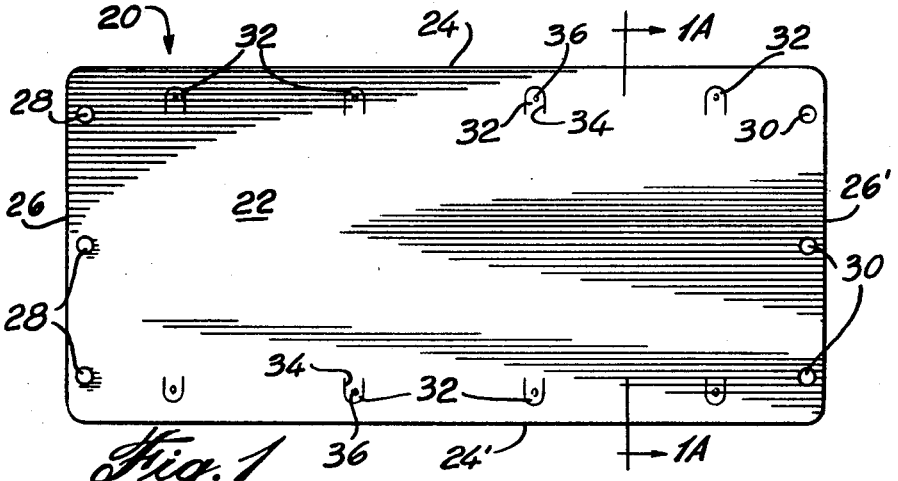
FIG. 1 is a plan view of a blank for forming a bag support according to the invention.

Referring first to FIG. 1, the blank illustrated and generally designated by reference numeral 20 is seen to comprise a rectangular sheet 22 of flexible material having a pair of longitudinal edges 24,24' and a pair of side edges 26,26'. Three knobs 28 are integrally formed in the sheet 22 adjacent the side edge 26 and corresponding openings 30 are provided adjacent the side edge 26' for receiving in snap-fit engagement the knobs 28. The knobs and openings 28,30 constitute fasteners for releasably holding the sheet 22 after being formed into a cylindrical shape so that the sheet retains its cylindrical form.

A plurality of partially cut-out tabs 32 and respective cut-out openings 34 are spacedly arranged djacent each longitudinal edge 24,24' and are aligned parallel thereto. Each tab 32 extends in a direction toward its adjacent longitudinal edge and is resiliently urged to normally close its respective opening 34. The tab and opening arrangement 32,34 constitutes a bag attachment means for releasably securing the bag in an open-mounted position when the blank is formed into the bag support. In order to easily locate by one's finger the tabs 32, each tab is provided with an embossement 36.

Figure 1A:
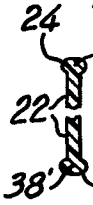
FIG. 1A is a fragmentary cross-section taken along line 1A—1A of FIG. 1.

In order to prevent the longitudinal edges 24,24' from cutting through the bag during use, these edges are provided with beads 38,38' extending therealong, as best shown in FIG. 1A. The four corners of the sheet 22 are also rounded for the same purpose.

Figure 2:
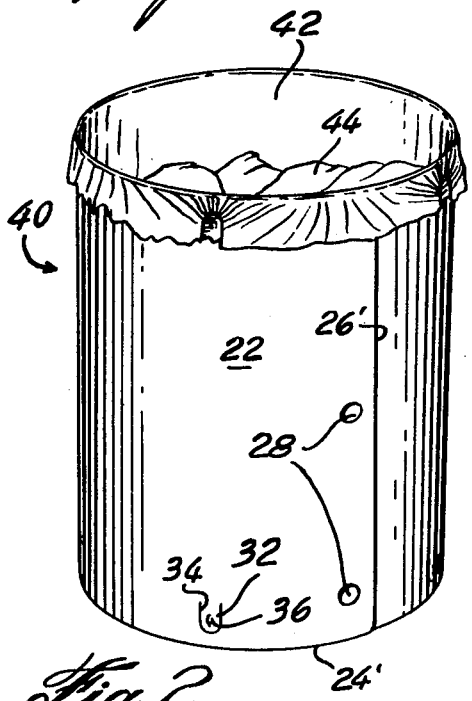
FIG. 2 is a perspective view illustrating the bag support in the assembled position as formed from the blank represented in FIG. 1, and supporting a loaded garbage bag received therein.
Figures 4, 5, 6, 7, 13:
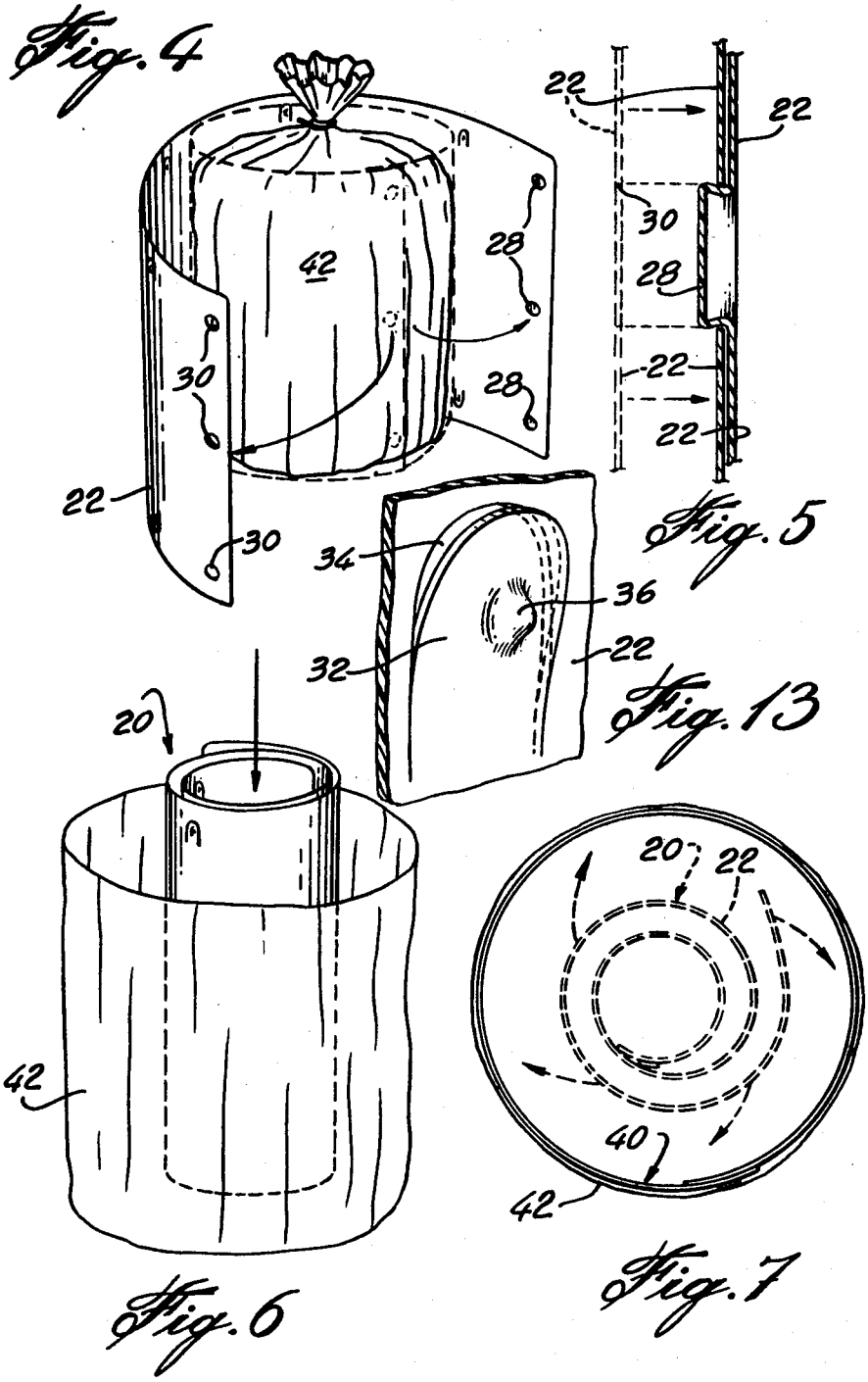
FIG. 4 is a view similar to that of FIG. 3 showing an alternate way of liberating the bag from its support.
FIG. 5 is a fragmentary sectional view illustrating the type of fastening means used for releasably holding the bag support in the assembled position.
FIG. 6 is a perspective view showing how the blank may be inserted into a garbage bag.
FIG. 7 is a top view illustrating how the blank can be expanded inside the bag to form a bag support lining the inner sidewall of the bag.
FIG. 13 which is on the same sheet as FIGS. 4–7 is a fragmentary perspective view showing details of the tab and opening arrangement used for attaching the bag.

The open-ended cylindrical bag support illustrated in FIG. 2 and generally designated by reference numeral 40 is obtained by bending the blank 20 represented in FIG. 1 and bringing the sides thereof in close overlapping relationship so as to thereby form the sheet 22 into a cylindrical shape. Next, the fasteners 28,30 are snapped together, as best shown in FIG. 5, thereby enabling the sheet to retain its cylindrical form. It should be noted that the longitudinal beaded edges 24,24' of the blank 20 define the end edges of the bag support 40 and that these remain parallel with one another. It should also be noted that since the cylindrical support is open at both ends thereof and since a series of tabs and openings 32,34 is provided at either end of the support and either end edge is similarly beaded, each end of the support 40 may be equally used to receive a bag so that there is no confusion between the "top" and "bottom" of the bag support.

As shown in FIG. 2, the bag support 40 holds a plastic garbage bag 42 received therein in an upright position, the bag 42 being securely held in an open-mouthed position for accomodating the garbage 44 by means of the bag attachments 32, 34 provided at the upper end of the support. The garbage can thus be compressed inside the bag, thereby enabling one use the bag to its full capacity. It should be noted that the cylindrical support 40 has a constant diameter throughout its length and is not of the tapered design as in conventional bag supports; accordingly, the bag can be completely loaded while being held by the support 40 and there is therefore no necesity to withdraw the bag from its support in order to complete the loading. A lid can of course be placed over the bag support 40.

Figure 3:
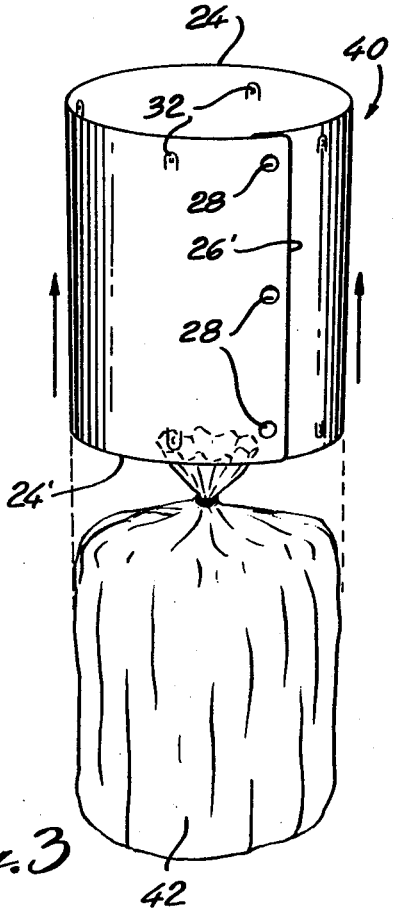
FIG. 3 is another perspective view showing how the garbage bag can be liberated from its support.

Once the bag 42 is loaded, it can be pulled out of the support 40 after having released the bag attachment 32,34 and tied the bag or, more simply, the support 40 may be lifted over the bag so as to allow the bag to remain on the ground and exit through the lower end of the support, as shown in FIG. 3. This latter procedure is quite advantageous when being faced with a relatively heavy bag since there is no need to lift such heavy bag off ground. Alternatively, the support 40 can be dissassembled by unsnapping the fasteners 28,30 so as to expose the bag which remains also on the ground, as shown in FIG. 4. As it is apparent, the bag support 40 eliminates the problems caused by the vacuum and bag adherence encountered with conventional bag supports.

Figure 8:
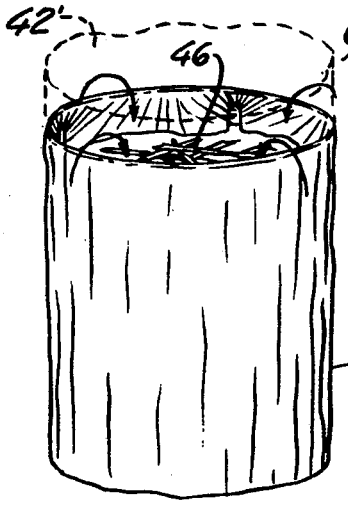
FIG. 8 is a perspective view showing the bag support in the assembled position inside the bag and serving as a liner to protect the bag against sharp objects loaded therein.
Figure 9:
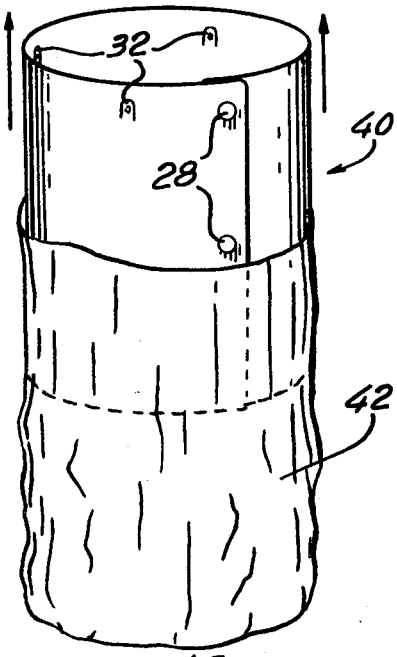
FIG. 9 is a perspective view showing how the liner may be withdrawn from the bag once loaded.

Turning to FIGS. 6 through 9, the bag support 40 may also be inserted inside the garbage bag 42. This can be conveniently done by first rolling the blank 20 upon itself and then inserting the blank in the rolled form into the garbage bag 42, as shown in FIG. 6. Next, the coiled blank is expanded to the cylindrical form so as to fit the inner sidewall of the bag and the fasteners 28,30 are snapped together, thus forming the bag support 40, as shown in FIG. 7. A peripheral end portion 42' of the bag is thereafter folded inwardly over the top edge of the support and secured to the support by means of the bag attachments provided at the upper end thereof, as shown in FIG. 8. The bag support 40 thus serves as a protective liner for the bag and enables one to load garbage containing sharp objects 46 such as pieces of broken glass and split wood without such sharp objects piercing the bag 42. The protective liner also allows the sharp objects 46 to be compressed inside the bag without causing damage thereto. Once the bag is loaded, the bag support 40 can be simply withdrawn from the bag 42, as shown in FIG. 9.

Figure 10:
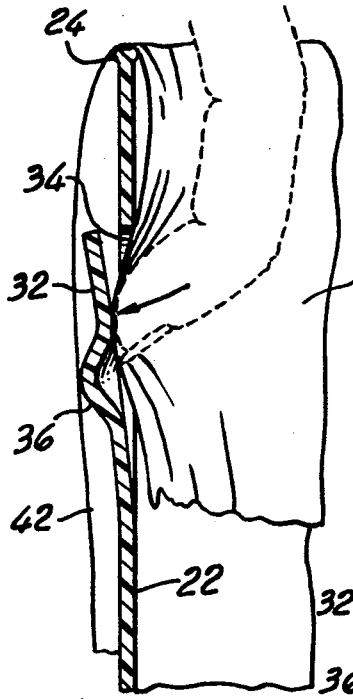
FIGS. 10–12 are fragmentary sectional views illustrating how a peripheral end portion of the bag can be secured to the bag support adjacent the top edge thereof.
Figure 11:
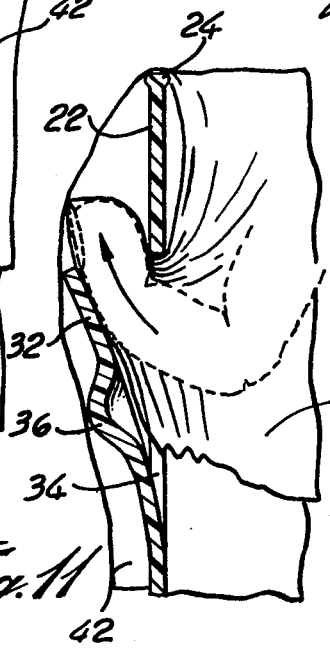
Figure 12:
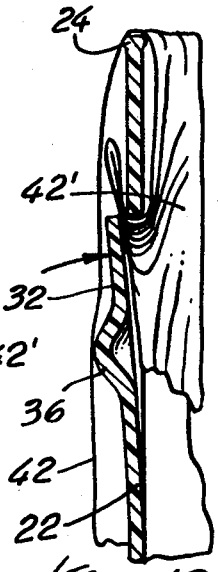

With reference to FIGS. 10 through 12, the bag peripheral end portion 42' represented in broken lines in FIG. 8 is secured to the support by first folding the bag end portion 42' inwardly over the top edge 24 an then inserting a part thereof with one's finger through the cut-out opening 34 against the closing force exerted by the tab 32, as best shown in FIGS. 10 and ll. Withdrawal of the finger causes the tab to move against the part of the bag end portion 42' protruding from the opening 34 to thereby entrap same therebetween, as shown in FIG. 12. Repeating this procedure for each tab and opening arrangement 32,34 provided at the upper end of the support enables the bag to be positively held in an open-mouthed position for loading. In the case where the bag 42 is disposed interiorily of the support rather than exteriorily thereof, such as in FIG. 2, the same procedure is followed with the exception of course that the bag peripheral end portion is folded outwardly instead of inwardly and the tabs are pressed inwardly rather than outwardly.

Since the bag 42 or the peripheral end portion 42' thereof generally hides the tabs 32 from the view, each tab may be easily located by means of the embossement 36 provided thereon. As best shown in FIG. 13, the embossement 36 which is integrally formed in each tab 32 is disposed substantially centrally of the tab and outwardly projects therefrom so as to be readily located by one's finger. As also shown, each tab 32 is formed with a smooth curved edge for engaging the bag without damaging same.

As it is apparent, the bag support 40 can be easily collapsed into a flat or coiled structure after having unsnapped the fasteners 28,30. When lying flat, the sheet 22 may be conveniently cleaned. As already mentioned, several sheets 22 may be rolled together into a hollow cylindrical bundle with garbage bags packed inside for marketing purposes.

The flexible sheet material out of which the blank 20 is made can be, for example, plasticized cardboard, fiberboard or linoleum. A sheet material available under the trademark NEW-TOP and manufactured by KSH Canada Ltd, Bramelea, Ontario, Canada has also been found very adequate. The blank can be manufactured from a roll of the sheet material at a production rate of about 1 unit/sec., using a suitable die. The dimensions of the blank and the diameter of the cylindrical support produced therefrom and suitable for accomodating most known bag sizes are given, by way of examples, in the following table:

TABLE

| Bag Size (inch)s | Dimensions of Blank (inch) Length | Width | Diameter of Cylindrical Support (inch) |
|---|---|---|---|
| 30 × 48 | 63 | 30 | 18¾ |
| 26 × 36 | 53 | 24¾ | 16 |
| 26 × 33 | 53 | 23 | 16 |
| 24 × 30 | 50 | 21 | 15¼ |
| 9 × 9 × 18 (pleated) | 35½ | 10½ | 10½ |

Although the bag support 40 illustrated and described is cylindrical in shape, the invention is of course not limited to such cylindrical form. For example, the blank 20 shown in FIG. 1 can be provided with three fold lines extending parallel to the side edges 26, 26'and subdividing the sheet into four panels such that the blank may be folded into an open-ended rectangular bag support. In addition, the support 40 is not limited to garbage bags or bags in general since it may also be used as an aid in packing cloths for storage, as compost container or can be used to hold rolls of wall paper, wrapping paper and the like for storage or display. 9n

I claim:

1. A collapsible support for bags, said support being formed from a one-piece blank made of flexible sheet material and having fastening means holding said sheet material to define an open-ended form-retaining structure of substantially constant cross-section for receiving a bag positionable interiorily or exteriorily thereof and supporting same in an upright open-mouthed position, said form-retaining structure having a solid circumferential sidewall extending substantially the full height of said bag in its upright position and terminating short of the open end thereof such as to permit a peripheral end portion of said bag to be folded over an uppper edge of said sidewall and to be retained adjacent said upper edge by bag attachment means integrally formed in said sheet material and adapted to releasably secure said bag in said open-mouthed position, said bag attachment means comprising a plurality of partially cut-out tabs and respective cut-out openings formed in said sheet material and spacedly arranged adjacent at least one of opposite end edges thereof, each said tab extending in a direction toward said at least one end edge and being resiliently urged to normally close its respective opening to thereby entrap therebetween said peripheral end portion of said bag folded over said one end edge constituting said upper edge and received through said respective opening, each said tab further having a smooth curved edge for engaging the folded peripheral end portion of said bag without damaging same.

2. A bag as claimed in claim 1, wherein said tabs are each provided with tab locating means.

3. A bag support as claimed in claim 2, wherein each said tab locating means comprises an embossement disposed substantially centrally of each tab and outwardly projecting therefrom.

4. A bag support as claimed in claim 1, wherein said releasable fastening means comprise at least one knob integrally formed in said sheet material adjacent one of opposite side edges thereof, said at least one knob being received in snap-fit engagement through a corresponding opening provided in said sheet material adjacent the other side edge thereof.

5. A bag support as claimed in claim 2, wherein said open-ended structure is cylindrical in shape.

6. A bag support as claimed in claim 5, wherein said sheet material forming said open-ended cylindrical structure has opposite parallel end edges.

7. A bag support as claimed in claim 6, wherein each said end edge is provided with a bead extending therealong.

8. A one-piece blank for forming a collapsible support for bags, said blank comprising an elongated sheet of flexible material having a pair of parallel longitudinal edges and a pair of transverse side edges, and fastening means adjacent said side edges for holding said sheet to define an open-ended form-retaining structure of substantially constant cross-section for receiving a bag positionable interiorily or exteriorily thereof and supporting same in an upright open-mouthed position, when said blank is formed into said support; said sheet having a width dimensioned such that said form-retaining structure has a solid circumferential sidewall extending substantially the full height of said bag in its upright position and terminating short of the open end thereof such as to permit a peripheral end portion of said bag to be folded over an upper edge of said sidewall and to be retained adjacent said upper edge by bag attachment means integrally formed in said sheet material adjacent at least one of said longitudinal edges and adapted to releasably secure said bag in said open-mouthed position, when said blank is formed into said support; said bag attachment means comprising a plurality of partially cut-out tabs and respective cut-out openings spacedly arranged adjacent said at least one longitudinal edge thereof and aligned parallel thereto, each said tab extending in a direction toward said at least one longitudinal edge and being resiliently urged to normally close its respective opening to thereby entrap therebetween said peripheral end portion of said bag folded over said one longitudinal edge constituting said upper edge and received through said respective opening, each said tab further having a smooth curved edge for engaging the folded peripheral end portion of said bag without damaging same.

9. A one-piece blank as claimed in claim 1, wherein said releasable fastening means comprise at least one knob integrally formed in said sheet adjacent one of said side edges, a corresponding opening being provided in said sheet adjacent the other side edge thereof for receiving in snap-fit engagement said at least one knob.

10. A one-piece blank for forming a collapsible support for bags, said blank comprising a rectangular sheet of flexible material having a pair of longitudinal beaded edges and a pair of side edges with rounded corners, at least one knob integrally formed in said sheet adjacent one of said side edges and a corresponding opening provided in said sheet adjacent the other side edge thereof for receiving in snap-fit engagement said at least one knob so as to releasably hold said sheet to define an open-ended form-retaining cylindrical structure of substantially constant diameter for receiving a bag positionable interiorily or exteriorily thereof and supporting same in an upright open-mouthed position, when said blank is formed into said support; said sheet having a width dimensioned such that said form-retaining structure has a solid circumferential sidewall extending substantially the full height of said bag in its upright position and terminating short of the open end thereof; said blank further including a plurality of partially cut-out tabs each formed with a smooth curved edge and respective cut-out openings spacedly arranged adjacent each said longitudinal edge and aligned parallel thereto, each said tab extending in a direction toward its adjacent longitudinal edge and being resiliently urged to normally close its respective opening, an embossement being provided substantially centrally of each tab and outwardly projecting therefrom.

11. A bag support as claimed in claim 1, wherein said fastening means are releasable fastening means.

12. A one-piece blank as claimed in claim 8, wherein said fastening means are releasable fastening means.

* * * * *